United States Patent [19]

Bahnsen et al.

[11] 4,427,520

[45] Jan. 24, 1984

[54] DEVICE FOR ELECTROPLATING A PORTION OF A MOVING WORKPIECE

[75] Inventors: Heiner Bahnsen, Augsburg; Daniël Hosten, Kortemark, both of Fed. Rep. of Germany

[73] Assignee: Siemens Aktiengesellschaft, Berlin & Munich, Fed. Rep. of Germany

[21] Appl. No.: 344,060

[22] Filed: Jan. 29, 1982

[30] Foreign Application Priority Data

Mar. 5, 1981 [DE] Fed. Rep. of Germany ..... 3108358

[51] Int. Cl.[3] ..... C25D 17/00; C25D 5/08

[52] U.S. Cl. ..... 204/224 R; 204/206; 204/202; 204/198; 204/28; 204/15

[58] Field of Search ..... 204/224 R, 206, 275, 204/198, 15, 28, 202, 225; 427/282; 239/589

[56] References Cited

U.S. PATENT DOCUMENTS

| | | | |
|---|---|---|---|
| 3,772,103 | 11/1973 | Holowka et al. | 427/282 |
| 4,029,555 | 6/1977 | Tezuka et al. | 204/206 |
| 4,155,815 | 5/1979 | Francis et al. | 204/198 |
| 4,161,280 | 7/1979 | Kasinskas | 239/589 |
| 4,163,704 | 8/1979 | Murata | 204/224 R |
| 4,186,062 | 1/1980 | Eidschun . | |
| 4,294,669 | 10/1981 | Lincoln et al. | 204/224 R |

FOREIGN PATENT DOCUMENTS

| | | |
|---|---|---|
| 2017527 | 10/1971 | Fed. Rep. of Germany . |
| 1569994 | 6/1980 | United Kingdom . |

*Primary Examiner*—T. Tung
*Assistant Examiner*—Nathan S. Thane

[57] ABSTRACT

A device for electroplating portions of a continuously moving, cathodically connecting workpiece as it is moved past a plurality of anodically connected spray nozzles characterized by the spray nozzles comprising precious metal and being positioned one after another in a row along the direction of movement of the workpiece with each of the nozzles having an individual stream of electrolytes emerging unimpeded therefrom. The continuously moving workpiece is positioned so that selected portions thereof are moved along the row of nozzles to be contacted by the stream of electrolyte emerging from the individual nozzles for a free and unimpeded electroplating of the portions contacted by the streams.

17 Claims, 7 Drawing Figures

DEVICE FOR ELECTROPLATING A PORTION OF A MOVING WORKPIECE

BACKGROUND OF THE INVENTION

The present invention is directed to a device for electroplating portions of parts which are combined into conductive band-like workpiece which is cathodically connected and is continually moved past an anodically connected spray nozzle.

A device for electroplating portions of parts, which are interconnected as a band or strip-like workpiece that is connected as a cathode and is moved past a spray nozzle, which is connected as an anode, is disclosed in U.S. Pat. No. 4,029,555 whose disclosure is incorporated by reference thereto. In this known device, an erect endless band is conducted through a self-contained type of tunnel of an electroplating cell. In the tunnel the band is covered by masks in such manner that only those particular areas or portions which are to be provided with a metallic layer remain exposed. A slot-shaped nozzle, which is connected as an anode is positioned to lay opposite this exposed area in such manner that an electrolyte is sprayed perpendicularly against the band or workpiece. The electrolyte, which flows down and is collected below the slot-shaped nozzle, is subsequently re-used. The length of the slot-shaped nozzle extends practically over the entire length of the electroplating cell and due to the slot-shaped design of the nozzle, the electrolyte emerges relatively uniformly over the entire length of the nozzle. However, as experience has shown, when a plurality of electronic components are combined into individual strips, plates or the band-like workpiece, the beginning and end of the band-like workpiece will exhibit a thicker coating because the current density concentrations at the ends of the strips are greater.

A method and a device for the application of metallic coatings on parts has become known in very general terms and is disclosed in German OS No. 20 17 527. In this particular reference, the individual parts which are to be treated are passed under spray nozzles with the assistance of a conveyor belt. In this arrangement, it has been proposed that if needed, a plurality of spray nozzles can be attached next to one another in the direction of movement and/or behind one another, and, if need be, at both sides. If the application of the metallic coatings is to occur by means of a current, such as in electroplating, the conveyor belt is connected as a cathode and the anodes are disposed in a container filled with the electrolyte and preferably are situated close to the spray nozzles. A partial electroplating, which is limited to specific areas, is not suggested nor disclosed by this particular method and cannot be obtained by this particularly known device.

Another device for selectively electroplating of metals is is disclosed in British Patent Specification No. 1,569,994, which claims priority from the German OS No. 25 51 988. In this device, an electrolyte liquid is applied in the form of a free stream to the stationary surface which is to be provided with the coating. Either the nozzle or a part of the nozzle is connected as the anode and the surface to be electroplated is connected as a cathode.

It has also become known from this disclosure to dispose a plurality of nozzles next to one another and to be opposite one another. Such a nozzle arrangement is provided for the selective partial electroplating of a stationary pin combs. Each pin comb is secured and electrically connected with the assistance of a support mount. The nozzles are secured in a pivotabe support mount and are directed against the pins of the comb. Since the pins are stationary relative to the nozzles, the spacing of the nozzles from one another must be equal to the spacing of the pins on the comb. Since in practice one cannot avoid the fact that the electrolyte streams emerging from the nozzles differ from one another a plating of the different thicknesses will occur on different pins. In this arrangement, the nozzle lie opposite one another. Thus, one cannot avoid the mutual obstruction between the streams of the nozzles which are disposed opposite each other.

A device for plating the terminal pins of a printed circuit board is disclosed in U.S. Pat. No. 4,186,062, whose disclosure is incorporated by reference. In this arrangement, the circuit boards are seized by two belts disposed at both surfaces and conducted through an electroplating cell. The two belts tightly cover the areas of the circuit board which are not to be plated. The electroplating occurs in that the electrolyte is supplied to the board via a plurality of holes which are directed in an upward direction and disposed in a row. With the assistance of a curved surface forming a foil, the electrolyte stream is deflected into a specific direction in such manner that a type of Venturi effect will occur at the circuit board to prevent flow of the fluid into undesired locations.

SUMMARY OF THE INVENTION

The present invention is directed to an improved device for electroplating selected portions of a workpiece which may be parts interconnected as either a strip, band or tape or as a comb or plate. The device assures not only a uniform layer thickness with a very small difference in the layer thickness but also enables achieving every possible distribution for the layer thickness.

To accomplish this object, the invention is directed to an improvement in the device for electroplating selected portions of a band-like workpiece which may be a printed circuit board, a strip or tape of interconnected parts or a comb-like band having a plurality of individual parts extending from an edge thereof. The device has at least one anodically connected spray nozzle and means for cathodically connecting the workpiece and for continuously moving the workpiece along a given direction past said nozzles. The improvement comprises the anodically connected spray nozzle comprising a plurality of nozzles of precious metal being positioned in at least one row extending along said given direction with each of said nozzles having an individual stream of electrolyte emerging unimpeded therefrom, and said means continuously moving the selected portions of the workpiece along the row of nozzles to be contacted by the streams of electrolyte emerging from the individual nozzles for a free and unimpeded electroplating of the portions contacted by said stream.

Because the workpiece passes each individual nozzles, and due to the continuous movement of the workpiece past the nozzles, a layer thickness, which always remains the same, is generated. The thickness of the layer thickness depends among other things upon the velocity with which the workpiece passes the individual nozzles. Thus, since the current density along the row of nozzles remains practically constant because each individual nozzle practically forms its own electroplating cell together with the cathodically connected tape or workpiece opposite the nozzle, the workpiece will not exhibit a thicker coating in areas adjacent the beginning and the end than it does in the areas at the center of the workpiece. Also, the spacing of the individual spray nozzles from one another can be selected in such manner that the individual cells have practically no mutual influence on one another.

The diameter of the nozzles and the spacing of the nozzles from the workpiece is preferably dimensioned in such manner that a current density distribution which corresponds to the desired layer thickness distribution will occur between the workpiece and the nozzles. By so doing, any desired layer thickness distribution can be achieved so that for example, multi-point plugs, which have areas which are exposed to greater wear, can be provided with a thicker coating in those particular areas. Thus, as experience has shown when providing precious metal contacts, a significant savings of precious metal can be achieved.

According to another feature of the present invention, when electroplating portions on parts which are interconnected together with a desired spacing t, the spacing between the individual nozzles will not be equal to the spacing t, or a multiple of the spacing t. In this regard, the inventive device significantly differs from the device according to the above mentioned British Patent Specification in which the spacing of the nozzles from one another must equal the spacing of the pins on the comb because unequal layer thickness distribution will occur if the spacing was not the same. While the spacing between the individual spray nozzles from one another is not equal to the spacing between the parts forming the workpiece, the overall dynamic pressure of the stream from each of the nozzles is approximately equal so that the strength of the indivdual spray streams is not subject to any fluctuations. This arrangement plays a significant part when the nozzles are disposed close to the area on the tape, which is to be electroplated or coated. By placing the ends of the nozzles as close as possible to the areas to be electroplated, one achieves significantly higher current densities between the nozzles and the workpiece, which densities produce a higher plating rate. Thus, either the overall structural length of the nozzle arrangement can be made shorter or the velocity of movement of the workpiece can be increased.

In order to obtain the desired distribution of layer thicknesses, another feature of the present invention utilizes individual spray nozzles, which have a smaller diameter than the width or height of the area on the workpiece to be electroplated, and the individual spray nozzles are not disposed directly behind one another and parallel to the direction of movement but rather are disposed with a perpendicular offset so that the row is slightly skewed to the direction of movement. Thus, the first spray nozzle in the row will cover the uppermost area while the last spray nozzle of the row will cover the lowermost area. In practice, this can be realized in a simple manner in that the nozzles, which are preferably provided in a group are inserted in a common container to extend on a line and the container is positioned with this line being skewed to the direction of movement. Preferably this is accomplished by means of obliquely positioning the container relative to the direction of movement. With this particular type of positioning, the velocity of movement of the workpiece relative to the nozzles is adjusted in order to achieve the specific layer thickness.

It has been proven to be expedient to arrange the individual nozzles so that they are set at an angle with respect to the plane of the workpiece so that the sprayed electrolye will flow off the workpiece in the desired direction. By so doing, the ejection velocity of the electrolyte from the nozzles can be increased. The flow distribution of the electrolyte becomes all the better the more this angle deviates from a perpendicular with respect to the plane of the workpiece, so that areas of the coating which are at least partially sharply bounded, will be obtained.

When both sides of the workpiece are to be electroplated, the spray nozzles are preferably disposed in a known manner per se along at both sides of the workpiece. The spray nozzles of one row are preferably offset with respect to the nozzles of the other row so that the nozzles do not have a mutually disruptive effect on each other.

With a very high spray velocity for the electrolyte, it necessarily follows that the electrolyte will also be sprayed into areas, which are not to be electroplated and which then under certain conditions must be cleaned at a later time. In this case, it is advantageous that at least these areas of the workpiece are covered in a manner known per se by means of at least one mask. It has proven expediant for the masks to form a part of the guidance of the workpiece. If the workpiece is composed of a plurality of interconnected plug strips, plug pins or the like which are to be partially electroplated with the assistance of masks, then it is advantageous that the masks move along with the workpiece or, respectively, moves along with the portion of the workpiece with a compatible velocity in the area of the spray cell.

As has already been explained hereinabove, it is desirable that the spray nozzles which are disposed at least at one side of the workpiece, are inserted in a common carrier for the formation of a spray cell. This container is designed and kept under pressure so that each electrolyte stream emerging from the individual spray nozzles will exhibit approximately the same strength. A particularly simple construction of the spray cell inventively occurs if the spray nozzles consist of a small precious metal tube, for example, platinum, which are inserted in a tubular container consisting of a corrosion-resistant material, for example titanium. This container is preferably closed at one end and has the other end provided with a connection part for the electrolyte liquid. However, if the container is long, each end may have a connection part for the electrolyte. So that approximately the same electrolyte pressure arises at each spray nozzle, it is desirable that a distributor tube is concentrically disposed within the container and has apertures which are positioned to face away from the spray nozzles. The electrolyte is discharged from the distributor tube through the aperture into the container to subsequently flow to the nozzles.

A container containing the row of spray nozzles can be adjusted in a simple manner relative to the surface of the workpiece so that the spacing of the spray nozzles from the workpiece and the direction of the stream with respect to the workpiece can be changed. Thus, the spray direction can be changed in a simple manner when the container is mounted by means which enable pivoting the container around its longitudinal axis and moving the axis away and toward the workpiece.

DESCRIPTION OF THE PREFERRED EMBODIMENTS

Figure 1:
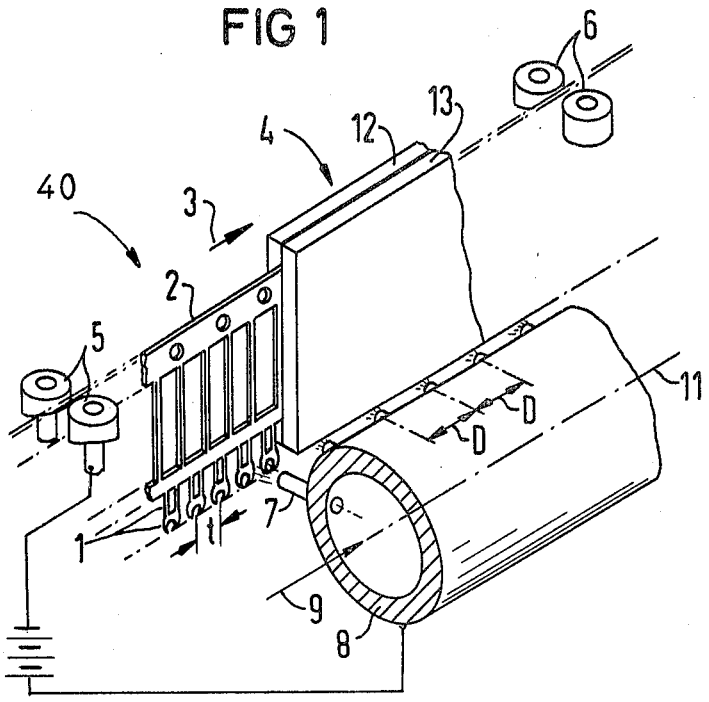
FIG. 1 is a perspective view with portions broken away and in cross-section of the device in accordance with the present invention which enables electoplating desired surface areas or portions of a workpiece being moved in the device as indicated by dot-dash lines.

The principles of the present invention are particularly useful when incorporated in a device generally indicated at 40 which has an electroplating cell 4 for electroplating selected portions of a workpiece 2. The workpiece 2 is illustrated as a conductive band having a plurality of parts 1 extending from an edge thereof. After coating and other treatments, the parts 1 will be separated in a known manner from a remainder of the workpiece.

The workpiece 2 is usually wound onto a roll and is drawn off by a take-off device which is not illustrated. In a manner known per se, the workpiece will be directed through a plurality of pre-treatment stations and then finally directed into the actual electroplating device 40 which has the cell 4 whose principle parts is illustrated in the Figure.

The workpiece 2 is moved into the electroplating device 40 in the direction of arrow 3 by means for continuously moving the workpiece. As illustrated, the means is formed by a pair of contact rollers 5 which contact the workpiece 2 and are provided directly in front of the actual electroplating cell 4. The rollers 5 simultaneously serving as a guidance. The band is pressed lightly against a detent due to a slight oblique attitude of the contact rollers 5 relative to the feed direction 3. By so doing, a precise positioning of the workpiece relative to the spraying cell 4 will be obtained. The means for moving also includes a second pair of contact rollers 6, which also serve for contacting and guiding the workpiece as it leaves the particular electoplating cell 4. The workpiece 2 then continues its travel through the installation and is again wound onto a roll utilizing the assistance of a take-up device.

Figure 2A:
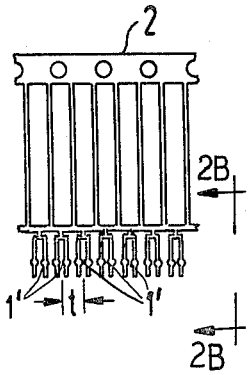
FIG. 2A is a partial plan view of a workpiece which is to be electoplated.
Figure 2B:
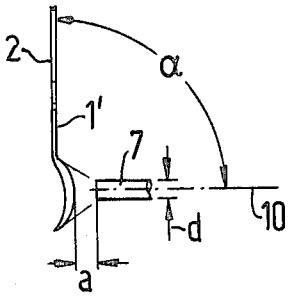
FIG. 2B is an enlarged view taken along the lines B—B of FIG. 2A.

In the electroplating cell 4, the workpiece 2 is conducted past a series of nozzles 7, which are inserted in a tubular container 8, which is designed as a spraying cell. As indicated by the arrow 9, electrolyte is pumped into the interior of the tubular container 8 along its axis 11, and emerges through the plurality of nozzles 7. The nozzles 7 are directed against the particular area B (see FIG. 5) to be electroplated or coated. As best illustrated in FIG. 2B, each of the nozzles 7 has a diameter d and is spaced a distance a from the surface of the part such as 1'. The spacing a and the diameter d of the nozzle are matched to one another so that the necessary current density distribution will be obtained to provide the desired layer thickness distribution.

Figure 4:
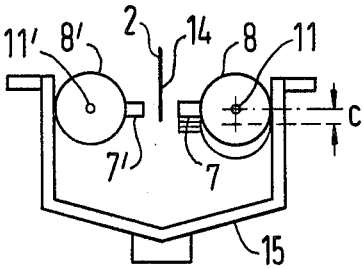
FIG. 4 an end view of the device according to FIG. 3 with portions removed for purposes of illustration.

The arrangement of the nozzle 7 relative to the area B of the part 1' is illustrated in an enlarged scale in FIG. 2B. The nozzle 7 is directed approximately perpendicular to the plane of the band 2 at an angle $\alpha$ between the nozzle axis 10 and the plane of the workpiece 2. When as illustrated in FIG. 2B, the area B of the part 1' has a curved cross-section, it is expedient that $\alpha=90°$. When this is not the case, then it is expedient that the angle $\alpha$ is selected smaller than 90°. This adjustment of the angle $\alpha$ can be undertaken in a simple manner by rotating the tubular container 8 around the longitudinal axis 11 (FIG. 4). The nozzles 7 as illustrated in FIG. 1 are inserted in the tubular container 8 and are preferably disposed along a line or row at an equal distance D from one another. Preferably, the parts such as 1 or 1' are spaced apart or are on centers of a spacing or a distance t as illustrated in FIGS. 1 and 2A. The distance D preferably is selected to be different than the spacing t and different than a multiple of the spacing t.

As illustrated in FIG. 1, the area of the workpiece 2 which is not to be electroplating, can be covered. This is undertaken, for example, by means of corresponding masks 12 and 13, which are elastically pressed against the workpiece 2. However, in the case of a workpiece consisting of individual parts, for example contact pins, which are more or less free-standing, there is then a danger that these parts 1 will be bent and damaged. In this case, it is expedient that the masks 12 and 13 according to FIG. 1 be carried along with the workpiece 2 with a compatible speed. This can be accomplished in a simple manner when constantly moving continuous belts are used as the masks 12 and 13 as suggested and described in the U.S. Pat. No. 4,186,062, whose disclosure was incorporated by reference thereto. By so doing, there exists the further possiblity of also being able to partially electroplate parts, such as pin combs or the like, which are combined into a strip-like workpiece and to also electroplate selected areas of circuit boards as well.

Figure 3:
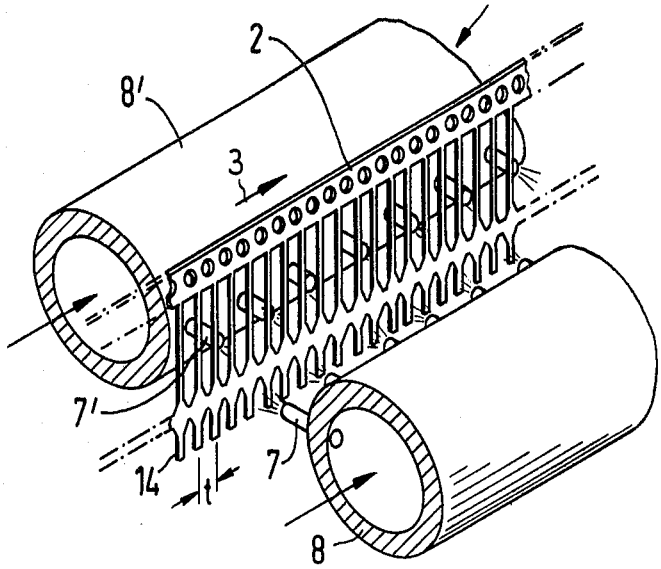
FIG. 3 a partial perpective view with portions broken away and in cross-section of an embodiment of the device of the present invention utilized two spray cells.
Figure 5:
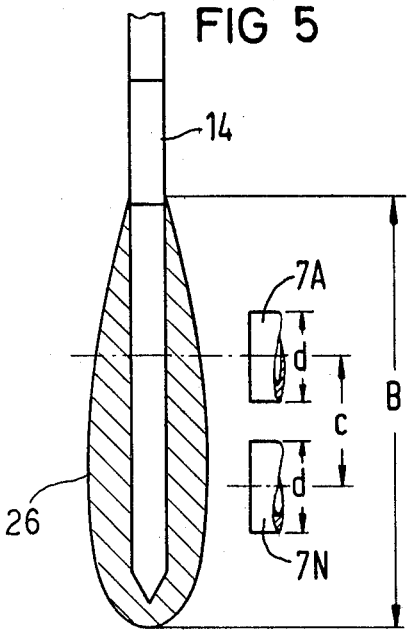
FIG. 5 in an enlarged cross-sectional view of a coated part with portions in elevation for purpose of illustration.

When the workpiece 2 has a plurality of parts such as contact pins 14, (FIG. 3) which are to be electroplated on both surfaces such as illustrated in FIG. 5, it is desirable to utilize an electroplating cell or device generally indicated at 40' in FIG. 3. The device 40' has a tubular container 8 supporting a row of nozzles 7 which are directed at one side of the parts or pins 14 and on the opposite surface has a second container 8' having a row of nozzles 7' which are directed at the opposite surface so that both sides or surfaces of the contact pin 14 will be electroplated. The disposition and the design of the row of nozzles 7 and 7' is essentially corresponding to the design essentially utilized in the device 40 of FIG. 1. However, in this case the nozzles 7 and 7' which are directed at one another, are offset so that a nozzle 7' is directed to a space between two adjacent nozzles 7. This results in the streams of the electrolyte, which emerge from the individual nozzles 7 and 7', do not mutually influence or disturb each another. The two tubular containers such as 8 and 8' are disposed within an electrolyte through 15 (FIG. 4) which has means to collect the excess electrolyte.

When, for example, the lower end of a contact pin 14 is to be electroplated in such a manner that the distribution of the layer 26 as illustrated in FIG. 5 arises, then a uniform layer thickness distribution can only be achieved when the diameter d of the individual nozzles 7 is sufficiently smaller than the height of the area B of the pin 14 which is to be electroplated. In addition, the nozzles such as 7A through 7N are laterally offset relative to the direction of motion indicated by the arrow 3 in FIG. 3 with the overall amount of offset C. This can be easily achieved in an electroplating device 40 or 40' of FIGS. 1 and 3 if the container such as 8 is placed to extend with its axis slightly skewed to the direction of movement 3 of the workpiece 7 with the amount of offset for the two ends or the two outermost nozzles 7 being the amount c. As illustrated in FIG. 5, the first spray nozzle 7A in the sequence of nozzles will cover the upper portion of the part or pin 14 with the last spray nozzle 7N covering another portion which is illustrated as the lowermost area. For the sake of clarity, the amount of offset c has been exaggerated. As already mentioned, any desired distribution of the layer thicknesses can be achieved in this manner. It is also noted, that to obtain the offset, the axis of the tubalar container 8 can be offset with its ends offset by an amount c as illustrated in FIG. 4.

Figure 6:
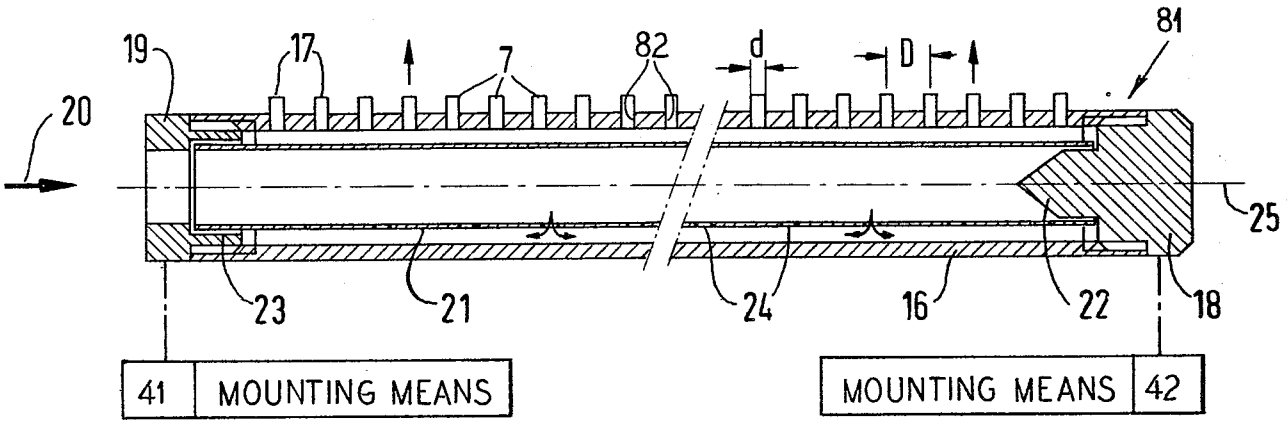
FIG. 6 is a cross-sectional view with portions in elevation for purposes of illustration of a preferred embodiment of a spraying cell in accordance with the present invention.

A preferred embodiment of a spray cell utilized in the electroplating devices is shown in cross-section in FIG. 6 and is particularly advantageously used when gold-plating. The cell, which is indicated at 81, consists of a tube 16 consisting of corrosion-proof material, for example titanium. A plurality of small tubes 17 consisting of precious metal, for example platinum, are mounted in a row on the tube 16 to form the row of nozzles 7. To accomplish, the tube 16 is provided with a row of bores 82 which receive the small tubes 17 which are pressed into the bores 82. A plug 18, which consists of a corrosion-proof material, for example a synthetic plastic and has a projecting part 22, is inserted into one end of the tube 16 and will tightly seal the end. The other end of the tube is provided with a fitting 19 for connection to a source of an electrolyte feed such as an electrolyte feed pipe schematically illustrated by the arrow 20. In order for the electrolyte stream to emerge uniformly at each small tubes 17, a distribution means is provided in the tube 16 and is illustrated as comprising a distribution tube 21 which is slipped over the projecting part 22 of the plug 18 and is supported at the opposite end in a corresponding bore 23 of the fitting 19. The distribution tube 21 is provided with passages or apertures, which are formed by bores 24, that are facing away from the small tubes 17, so that the electrolyte emerging through theses passages must flow around the distribution tube 21 before it arrives at the small tube 17 to be discharged through the nozzles. Finally, in order to mount the spray cells such as the container 81, support means schematically illustrated by boxes 41 and 42 mount each of the ends of the containers 81 so that it may rotate around the longitudinal axis 25 as well as have an axis 25 shifted to be skewed to a direction of movement by an amount c as mentioned hereinabove. The support means 41 and 42 also enables adjusting the distance a (FIG. 2B) from the surface or portion to be plated. It should be noted that each of the spray cells 8 and 8' in FIGS. 1, 3 and 4 are preferably designed as the unit 81 in FIG. 6. Finally, it should be noted that if the length of the unit 81 of FIG. 6 exceeds a given amount, the plug 18 can be replaced by a fitting 19 so that an electrolyte can be introduced into each end of the unit 81.

Although various minor modifications may be suggested by those versed in the art, it should be understood that we wish to embody within the scope of the patent granted hereon, all such modifications as reasonably and properly come within the scope of our contribution to the art.

We claim:

1. In a device for electroplating selected portions of a band-like workpiece having a plurality of parts extending from one edge with a spacing t therebetween, said device having at least one anodically connected spray nozzle and means for cathodically connecting the workpiece and for continuously moving the workpiece along a given direction past each nozzle, the improvement comprising each anodically connected spray nozzle comprising a plurality of nozzles of precious metal being positioned in at least one row extending along said given direction with each of said nozzles having an individual stream of electrolyte emerging unimpeded thereform, each row of nozzles being disposed on a surface of a common carrier with the spacing between nozzles of the row being a distance D which is different than the spacing t between parts and different than a multiple of the spacing t, said common container containing means for receiving electrolyte under pressure and distributing it to each of said nozzles to be discharged therefrom as a stream of electrolyte of approximately the same strength, and said means continuously moving the selected portions of the parts of the workpiece along the row of nozzles to be contacted by the streams of electrolyte emerging from the individual nozzles to enable a free and unimpeded electroplating of the portions contacted by said streams.

2. In a device according to claim 1, wherein each of the nozzles has a diameter d and has its end of the nozzle spaced a distance a from the workpiece, said distance a and diameter d being dimensioned in such a manner that a desired current density distribution between the workpiece and the nozzle produces the desired distribution of layer thicknesses.

3. In a device according to claim 1, wherein the diameter of each of the nozzles and the distance between each of the nozzles in the row is selected in such a manner that the streams of electrolyte emerging from each of the nozzles do not influence each other.

4. In a device according to claim 1, wherein each of the portions of the workpieces to be plated has a dimension in a vertical plane of movement and taken in the direction perpendicular to the direction of movement of the workpiece which is greater than the diameter of each of the individual spray nozzles, said individual spray nozzles being vertically offset to one another along the direction of movement with the first nozzle of the row being directed at a differnt portion of the dimension than the last nozzle of the row.

5. In a device according to claim 1, wherein each of the individual spary nozzles is positioned with its axis forming an angle $\alpha$ with the plane of the workpiece so that the electrolyte flows off of the workpiece in the desired direction.

6. In a device according to claim 1, wherein the spray nozzles are arranged in two rows with each row on a separate common container and with the nozzles facing each other, said means moving the workpiece between the two rows of nozzles and the nozzles of one row being positioned to be offset from the nozzles of the other row so that they are positioned in the gaps between the nozzles of the other row.

7. In a device according to claim 1, which includes means for forming a mask covering at least a portion of the workpiece.

8. In a device according to claim 7, wherein the means forming a mask forms part of the guidance for the workpiece in the device.

9. In a device according to claim 8, wherein the means forming the mask moves along with the workpiece at a compatible speed therewith at least over the length of the row of nozzles.

10. In a device according to claim 9, wherein the means for forming the mask comprises a pair of at least two endless belts gripping the workpiece therebetween and moving therewith.

11. In a device according to claim 7, wherein the means forming the mask forms a mask moving with the workpiece at a compatible speed at least over the length of the row of nozzles.

12. In a device according to claim 1, wherein each of the spray nozzles consist of a small precious metal tube, said container consisting of a tubular member of a corrosion-proof material with at least one end having a fitting for the introduction of the electrolyte fluid, said small tubes being disposed in bores in said tubular member.

13. In a device according to claim 12, wherein the precious metal tubes are platinum tubes and said tubular member comprises a titanium tube.

14. In a device according to claim 12, wherein the means for distributing the electrolyte under pressure comprises a distributor tube disposed inside of the tubular member and in communication with the fitting, said distributor tube containing a plurality of apertures facing away from the entrance ends of the precious metal tubes forming the spray nozzle so that the electrolyte pressure at each spray nozzle is approximately the same.

15. In a device according to claim 1, which includes means for adjustable mounting said container for movement relative to the workpiece, said mounting means enabling adjustment of the axis of the container relative to the direction of movement of the workpiece.

16. In a device according to claim 15, wherein the means for mounting enables rotating the container on its longitudinal axis.

17. In a device according to claim 1, wherein the container is provided with a fitting at each end for enabling introduction of an electrolyte thereto.

* * * * *